US009846018B1

(12) United States Patent
Schloer

(10) Patent No.: US 9,846,018 B1
(45) Date of Patent: Dec. 19, 2017

(54) SELF-ADJUSTING SHELL HOLDER FOR METALLIC CARTRIDGE RELOADING PRESSES

(71) Applicant: Mayville Engineering Company Inc., Mayville, WI (US)

(72) Inventor: Ted P. Schloer, Kewaskum, WI (US)

(73) Assignee: Mayville Engineering Company Inc., Mayville, WI (US)

( * ) Notice: Subject to any disclaimer, the term of this patent is extended or adjusted under 35 U.S.C. 154(b) by 0 days.

(21) Appl. No.: 15/343,415

(22) Filed: Nov. 4, 2016

(51) Int. Cl.

| | |
|---|---|
| ***F42B 33/02*** | (2006.01) |
| ***F42B 33/00*** | (2006.01) |
| ***F42B 33/04*** | (2006.01) |
| ***F42B 33/10*** | (2006.01) |

(52) U.S. Cl.
CPC ..... *F42B 33/002* (2013.01); *F42B 33/005* (2013.01); *F42B 33/04* (2013.01); *F42B 33/10* (2013.01)

(58) Field of Classification Search
CPC ..... F42B 33/00; F42B 33/001; F42B 33/005; F42B 33/04; F42B 33/10
USPC ..... 86/23–25, 32–33, 36–37, 44
See application file for complete search history.

(56) References Cited

U.S. PATENT DOCUMENTS

| | | | | | |
|---|---|---|---|---|---|
| 3,025,743 | A * | 3/1962 | Cecchi | F42L 339/10 | 279/114 |
| 3,107,575 | A * | 10/1963 | Paul | F42B 33/10 | 269/254 R |
| 3,157,407 | A * | 11/1964 | Aulabaugh | F42B 33/10 | 279/36 |
| 3,319,511 | A * | 5/1967 | McLean | F42B 33/002 | 86/23 |
| 3,896,699 | A * | 7/1975 | Cerro | F42B 33/002 | 269/254 R |
| 3,916,758 | A * | 11/1975 | Ashbrook | F42B 33/002 | 279/46.7 |
| 4,425,833 | A * | 1/1984 | Purdie | F42B 33/002 | 86/26 |
| 2007/0022870 | A1* | 2/2007 | Bond | F42B 33/001 | 86/24 |

* cited by examiner

*Primary Examiner* — John Cooper
(74) *Attorney, Agent, or Firm* — Boyle Fredrickson, S.C.

(57) ABSTRACT

A ram with a multi-axis, multi-directional "self-centering shell holder" having predetermined spacing with respect to its engagement with the shell holder so that the shell holder supporting the cartridge case has the ability to deviate from the ram centerline in any direction to re-align with a centerline of the die bore is provided. The present invention also provides a retaining clip with push down tab allowing for quick insertion and removal of the self-aligning shell holder from the ram top.

17 Claims, 3 Drawing Sheets

SELF-ADJUSTING SHELL HOLDER FOR METALLIC CARTRIDGE RELOADING PRESSES

CROSS-REFERENCE TO RELATED APPLICATIONS

Background of the Invention

The present invention relates to reloading presses for previously fired firearm cartridges, and in particular, to a self-adjusting shell holder for adjusting a die and case alignment on metallic firearm cartridge reloading presses.

Metallic reloading presses are used to reload metallic cartridges (straight walled or bottleneck cartridges typically made of malleable brass) commonly used in rifles and pistols. During firearm firing, a primer in the head or end of the cartridge is ignited detonating a mixture used to ignite the powder in the cartridge body. Ignition of the powder within the cartridge case increases the gas pressure within the cartridge case, causing the case to stretch and expand within the gun chamber, sealing the chamber. After firing, the used cartridge case is collected for reloading. Using various interchangeable dies, the reloading presses are used to reform and resize the cartridge case, de-cap the spent primer, re-seat the bullet in the cartridge case, and optionally crimp the metallic cartridge case for re-firing.

A sizing die is a particular die used to draw the cartridge case back to pre-firing shape and dimensions so it will fit within the gun chamber and hold the bullet securely. As the case enters the sizing die, the die squeezes the body down while shaping the shoulders of the case to provide a proper wall thickness and case diameter. As the case is withdrawn from the die, the neck passes over an expander ball, which expands the neck to provide the proper neck dimension when the bullet is seated at the mouth of the case. Often concurrent with sizing, a de-capping rod pushes out the spent primer from a primer pocket (located at the center of the end of a centerfire case) so that a new primer may be reseated in the case. After the cartridge cases are charged with powder, a seating die may be used to push or seat the bullet through the mouth of the case and into the neck of the case to achieve a proper overall cartridge length. A crimping die may be used during or after seating the die, with a combination seating/crimping die or a dedicated crimping die, to bend the mouth of the case inward to grip the bullet and provide additional hold between the case and the bullet.

The metallic reloading presses typically include a frame interchangeably receiving the various reloading dies. The dies include an inner cavity for receiving the previously fired cartridge cases therein for reforming, resizing and reseating. The frame also supports a ram, typically operated by a hand lever for holding the bottom of the metallic cartridge case so that the metallic cartridge case can be pushed into the die with a significant amount of force. The metallic cartridge case base is held by a shell holder, interchangeable for a particular case cartridge size, and attached to the ram so that the cartridge case may be brought into the inner cavity of the die along a ram centerline for proper reshaping, de-capping, reseating, and/or crimping.

Any imprecision in the operation of the reloading press affects the reforming of the cartridge and can adversely affect the accuracy of the resulting ammunition and prematurely degrade the cartridges.

SUMMARY OF THE INVENTION

The present inventors have recognized that manufacturing tolerances in the press, dies, and shell holders inevitably cause the ram centerline to be slightly misaligned from a centerline of the die bore. The slight misalignment of the cartridge case as it is pressed into the die may be exacerbated over time as the press is repeatedly used. Due to the misalignment of the ram, shell holder, and/or cartridge case into the die, the cartridge case may enter the die at a slight angle, causing the reshaping, de-capping, reseating, and crimping features of the die to be affected. For example, misalignment may cause slight variations in neck wall thickness or misalignment of the seated bullet causing shooting accuracy to be affected. Misalignment may also affect the ability of the de-capping rod to enter the small primer pocket and de-cap the spent primer from the case. This misalignment may be along an arbitrary direction away from the centerline.

Accordingly, the present invention provides a ram with a multi-axis, multi-directional "self-centering shell holder" having predetermined spacing with respect to its engagement with the shell holder so that the shell holder supporting the cartridge case has the ability to deviate from the rain centerline in any direction to re-align with a centerline of the die bore. The present invention also provides a retaining clip with push down tab allowing for quick insertion and removal of the self-aligning shell holder from the ram top.

In one embodiment, the present invention may provide a shell reloading press providing a vertically extending frame having an upper arm portion for supporting die elements and a lower arm portion supporting an elongate cartridge case to be pressed into the die elements, the press having: a ram supported by the lower arm portion having an upwardly exposed coupling and movable in a vertical direction along a ram centerline between an extended position and a retracted position; a shell holder having a head portion, the head portion providing an inner groove adapted to receive a rim of the elongate cartridge case to prevent separation between the elongate cartridge case and the shell holder along the ram centerline and a downwardly exposed coupling releasably coupling the upwardly exposed coupling to prevent separation between the shell holder and ram along the ram centerline; where a space is provided between the downwardly exposed coupling and the upwardly exposed coupling allowing a shell holder centerline to deviate from the ram centerline in at least two orthogonal axis by at least 0.01 inches. The space may allow the shell holder centerline to deviate from the ram centerline radially in all directions.

It is thus a feature of at least one embodiment of the invention to allow for positional readjustment of the cartridge case before entering the relatively fixed die mold. The readjustment is made by maneuvering the shell holder within the ram so that re-alignment may take place as the case cartridge is lifted into the die.

The upwardly exposed coupling may provide an inner bore. The downwardly exposed coupling may provide a neck portion extending downwardly from the head portion of the shell holder, the neck portion insertable into the inner bore of the ram. The neck portion may include an expanded portion passing through a corresponding T-slot where the expanded portion is retained within the T-slot along the ram centerline. The T-slot may be open at a side of the bore allowing the shell holder to slide perpendicular to the bore centerline such that the neck portion is received within the inner bore.

It is thus a feature of at least one embodiment of the invention to allow the shell holder and ram top to be fixed in a vertical direction using side entry of the shell holder into the bore top.

A spring-biased member provides a stop surface coupled to the ram resisting removal of the shell holder from the ram without applied pressure to the spring-biased member.

It is thus a feature of at least one embodiment of the invention to secure the self-adjusting shell holder within the ram top when space between the shell holder and ram top allow the shell holder to "float" within the top bore. It is also a feature to enclose the slide entry of the shell holder using a metal clip, which allows the shell holder to be installed and removed from the ram top using one hand flexing the clip and one hand installing the shell holder.

The spring-biased member may be an elastic form.

It is thus a feature of at least one embodiment of the invention that the spring-based member may be a flexible ring of material extending circumferentially around the ram top, such as an O-ring.

The spring-biased member may be a wire form. The wire form may provide first and second wire ends opposite shoulders and the first and second wire ends are received within first and second sockets in the ram so that shoulders of the wire form are depressed from the stop surface with flexure of the wire ends. The wire form may provide a handle portion projecting radially from the shoulders of the wire form to depress the shoulders when pressed.

It is thus a feature of at least one embodiment of the invention to allow flexure of the wire clip to a downward position to expose the side opening of the ram top while rebounding back to a biased upward position to enclose the side opening of the ram top. The flexure of the wire clip may provide a "ramp" allowing the shell holder to easily slide into the ram bore.

The die elements may include a die supported by the upper arm portion and having a die bore adapted to removably receive the elongate cartridge case when the ram is in the extended position.

It is thus a feature of at least one embodiment of the invention that the press is used in connection with die elements allowing the cartridge case to be lifted into or pressed into the die.

The ram may be movable along the ram centerline between the extended position and the retracted position by a lever arm coupled to the ram by a bolt permitting fixed rotational positioning of the lever arm.

It is thus a feature of at least one embodiment of the invention to allow a left-handed or right-handed orientation of a lever arm to be rotated for desired use.

There may be lateral wings extending from the frame and containing openings adapted to hold one more interchangeable dies.

It is thus a feature of at least one embodiment of the invention to provide convenient holders for various press equipment and interchangeable elements.

A deflector plate positioned to receive a lower end of the inner bore of the ram and angled downwardly and rearwardly toward a rear of the frame.

It is thus a feature of at least one embodiment of the invention to provide capture of the spent primers after the de-capping operation.

The present invention may also provide a method of operating a shell reloading press providing a vertically extending frame having an upper arm portion for supporting die elements and a lower arm portion supporting an elongate cartridge case to be pressed into the die elements, the press having a ram supported by the lower arm portion having an upwardly exposed coupling and movable in a vertical direction along a ram centerline between an extended position and a retracted position; and a shell holder having a head portion, the head portion providing an inner groove adapted to receive a rim of the elongate cartridge case to prevent separation between the elongate cartridge case and the shell holder along the ram centerline and a downwardly exposed coupling releasably coupling the first upwardly exposed coupling to prevent separation between the shell holder and ram along the ram centerline, the method including the steps of: moving the spring-biased member to a down state; inserting the neck portion of the shell holder into the inner bore of the ram; inserting the rim of the elongate cartridge case into the inner grove of the head portion of the shell holder; moving the ram to an extended position; and self-adjusting the alignment of the shell holder and cartridge case so that the shell holder centerline may deviate up to or at least 0.01 inches from the ram centerline.

These particular objects and advantages may apply to only some embodiments falling within the claims and thus do not define the scope of the invention.

DETAILED DESCRIPTION OF THE INVENTION

Figure 1:
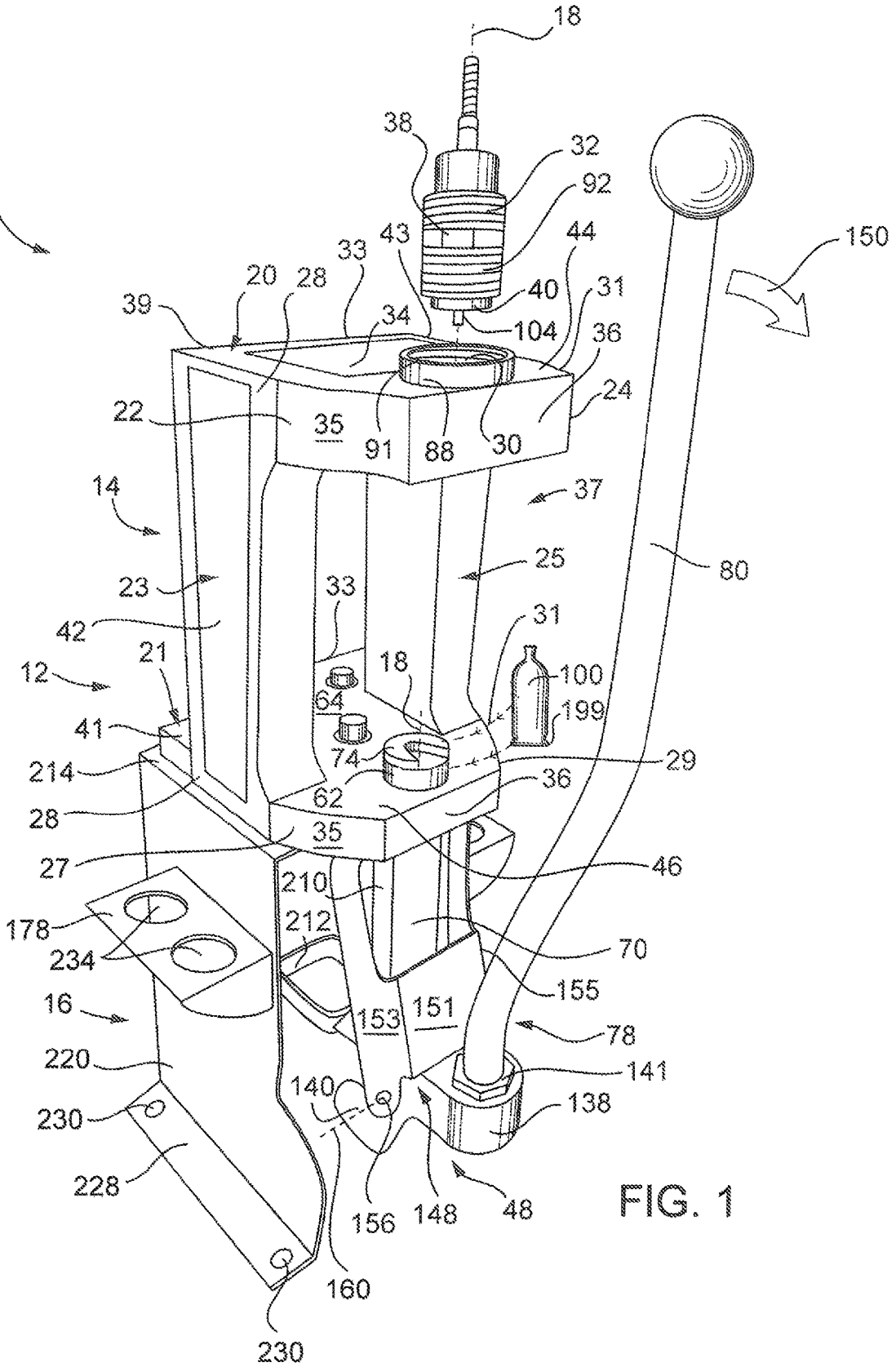
FIG. 1 is a perspective view of a cartridge reloading press of the present invention illustrating a frame supporting a lever arm movable downwardly to drive a ram upward toward a die.

Referring now to FIG. 1, a cartridge reloading press 10 according to one embodiment of the present invention may provide a press frame 12 defined by an upper C-shaped frame 14 supported below by a lower table support base 16. The C-shaped frame 14 has a top plate 20 extending parallel to and mounted opposite a bottom plate 21 along a centerline axis 18 and supported in separation by a pair of vertically extending support beams 23, 25 parallel to the centerline axis 18 and connecting corresponding left 28 and right 31 sides of the top plate 20 and bottom plate 21 near a rear 33 of the reloading press 10. In this way, the edges 35 of the top plate 20 and bottom plate 21 form a C-shape when viewed from a left side 28 providing a gap 37 therebetween free from vertically extending obstruction.

In one embodiment, the top plate 20 has a depth of approximately 0.5 to 1.5 inches or 1 inch along the centerline axis 18, a length of approximately 3 to 4 inches or 3.8 inches measured from front 36 to rear 33, and a width of approximately 4 to 5 inches or 4.5 inches measured from left 28 to right 31. The top plate 20 may have rounded cut edges 35 at a front-left 22 and front-right 24 corners to provide a smooth front edge 35.

The bottom plate 21 substantially mirrors the top plate 20 but having a lengthened posterior section 41 providing an elongated base. In one embodiment, the bottom plate 21 has a depth of approximately 0.5 to 1.5 inches or 0.75 inches along the centerline axis 18, a length of approximately 5 to 6 inches or 5.4 inches measured from front 36 to rear 33, and a width of approximately 4 to 5 inches or 4.5 inches measured from left 28 to right 31. The bottom plate 21 may also have rounded cut edges 35 at a front-left 27 and front-right 29 corner of the bottom plate 21 to provide a smooth front edge 35.

The top plate 20 and bottom plate 21 are separated by a pair of vertical beams 23, 25 extending between left 28 and right 31 sides of the top plate 20 and bottom plate 21. The left vertical beam 23 extends downwardly from a rear-left corner 39 of the top plate 20 and is attached to the bottom plate 21 at a left side 28 centered between the front 36 and rear 33. A right vertical beam 25 extends downwardly from a rear-right corner 43 of the top plate 20 and is attached to the bottom plate 21 at a right side 31 of the bottom plate 21 centered between the front 36 and rear 33.

The vertical beams 23, 25 have C-shaped cross-sections (taken perpendicular to the centerline axis 18) with the channels 42 opening outward to the left 28 and right 31. The channel 42 openings of the beams 23, 25 provide a grip for a user's hand.

A front portion 44 of the top plate 20 extends anterior to the vertical beams 23, 25 and corresponds with a front portion 46 of the bottom plate 21 also extending anterior to the vertical beams 23, 25 to form the upper and lower arms of the C-shaped frame 14, respectively, and defining the gap 37 free from both horizontal extension obstruction and vertical extension obstruction between the plates 20, 21, and interference from the vertical beams 23, 25.

The top plate 20 and bottom plate 21 support a die 32 and ram 70, respectively, which are generally aligned along the centerline axis 18 and driven toward each other during operation of the reloading press 10.

The top plate 20 supports a vertically extending die 32 aligned with the centerline axis 18. In one embodiment, the die 32 may be cylindrical to fit in sliding relation through a corresponding cylindrical bore 30 through the top plate 20. The bore 30 may accept any die using ⅞ of an inch diameter with 14 threads per inch. The bore 30 may be centered between left 28 and right 31 sides of the top plate 20. An upper rim of the die-receiving bore 30 may include an upwardly raised flange 88. An inner surface of the bore 30 may have internal threads 91 that correspond with external threads 92 of the die 32 to allow the cylindrical die 32 to slide within the bore 30 and be fixed in vertical relation with respect to the bore 30 by the interlocking of the threads 91, 92.

In one embodiment, the die 32 may be an elongated cylinder having an inner cavity 40 for receiving a previously fired cartridge case 100 therein. The die 32 may contain a lock ring 38 extending circumferentially around the die 32 and tightened around the threads 92 to prevent further extension of the die 32 into or out of the die-receiving bore 30. Certain additional features may be found in particular dies 32, such as a de-capping rod 104 formed within a center of the inner cavity 40 and extending out from the bottom of the die 32 for removing a spent primer of the previously fired cartridge case 100.

In use, the die 32 may be inserted along the centerline axis 18 into the die-receiving bore 30 by twisting or turning the die 32 along the centerline axis 18 to advance or retract the inter-engaging threads 91, 92 of the die 32 and bore 30.

The bottom plate 21 supports a vertically extending ram 70 aligned with the centerline axis 18 and thus with the die 32 held by the upper plate 20. The ram 70 may be moved vertically along the centerline axis 18 by means of a hand lever 48 that will be described below between an extended and retracted state.

In one embodiment, the ram 70 may be cylindrical to fit in sliding relation through a corresponding cylindrical bore 62 through the bottom plate 21. The bore 62 may be centered between the left 28 and right 31 sides of the bottom plate 21. An inner surface of the ram-receiving bore 62 may be smooth and an inner diameter of the ram-receiving bore 62 may be slightly larger than the outer diameter of the ram 70 to provide clearance allowing the ram 70 to slide within the ram-receiving bore 62 along the centerline axis 18.

In one embodiment, the ram 70 may be an elongated cylindrical shaft having an inner channel 90 running along the cylinder's length. A length of the ram 70 generally corresponds to a distance between the bottom plate 21 and the top plate 20 of the C-shaped frame 14 and a length necessary to lift a top 74 of the ram 70 to the die 32. The ram 70 may be approximately 6 to 10 inches or 8.4 inches long and may have an approximately 1 inch diameter.

In use, the ram 70 is installed within the bore 62 of the bottom plate 21 such that the ram top 74 is exposed to at a top surface 64 of bottom plate 21 and a ram bottom, opposite the ram top 74, is coupled to a lifting mechanism 78 that will be described below lifting the entire ram 70 along the centerline axis 18 in the extended state.

Referring to FIGS. 2-5, the generally cylindrical ram top 74 provides a coupling mechanism having a first coupling element 50 for attachment to a second coupling portion 52 of a shell holder 72 providing a floating coupling between the shell holder 72 and the ram top 74.

The first coupling element 50 provides a blind slot 56 extending diametrically across the axis 19 of the ram top 74 perpendicular to the centerline axis 18. This blind slot 56 starts at a first side opening 58 and extends to a location just short of an opposed vertical wall 54 of the ram top 74. A width 94 of the blind slot 56 perpendicular to its extension along the diameter and hence perpendicular to the centerline 18 is less than the outside diameter 96 of the ram top 74 to provide left and right blind slot side walls 82, 84 separated by a space distance 94. The upper extent of the slot 56 is positioned approximately ⅛ of an inch below an upper face 66 of the ram top 74 and the height of the slot 56 measured along the centerline 18 may be approximately ⅛ inch.

An access slot 164 is formed at the upper face 66 of the ram top 74 above and parallel to the blind slot 56. The access slot 164 also extends diametrically across the axis 19 of the ram top 74 perpendicular to the centerline axis 18 and starts at the first side opening 58 and extends to a location just short of the opposed vertical wall 54 of the ram top 74. However, the extension of the access slot 164 along the diameter is less than the extension of the blind slot 56. A width 98 of the access slot 164 perpendicular to its extension along the diameter and perpendicular to the centerline 18 is less than the width 94 of the blind slot 56 to provide left and right access slot side walls 86, 87 separated by a smaller space distance. The upper extent of the slot 56 extents through the upper face 66 of the ram top 74 and the height of the slot 56 measured along the centerline 18 may be approximately ⅛ inch.

The access slot 164 is smaller in width than the blind slot 56 so that the left and right access slot side walls 86, 87 of the access slot 164 extend over the left and right blind slot side walls 82, 84 of the blind slot 56 to provide left and right stop undersurfaces 99 at the front ends of the left and right access slot side walls 86, 87 restricting upward vertical extension along the front ends of the left and right blind slot side walls 82, 84.

Figure 3:
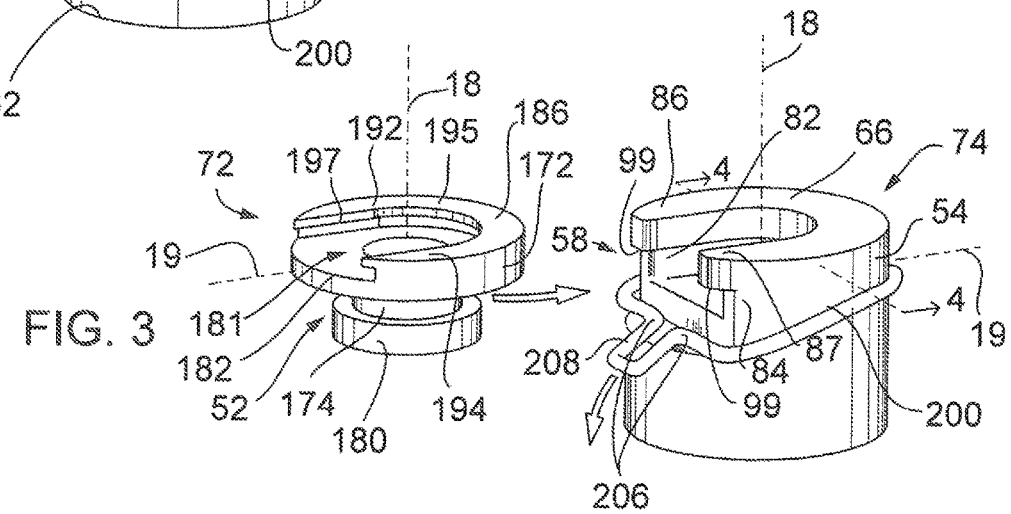
FIG. 3 is a perspective view of the top of the ram of FIG. 2 showing the retaining clip having shoulders depressed downward to allow insertion of the shell holder into the ram top.
Figure 4:
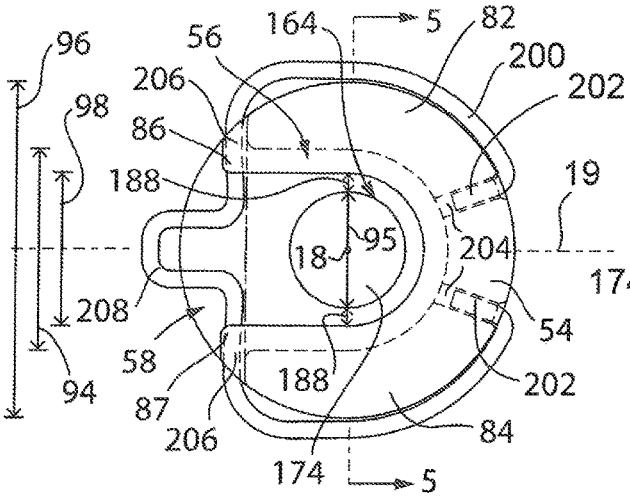
FIG. 4 is a top view of the top of the ram with the shell holder inserted within the ram top and a radial space provided around a neck of the shell holder allowing radial adjustment of the shell holder within the ram top.
Figure 5:
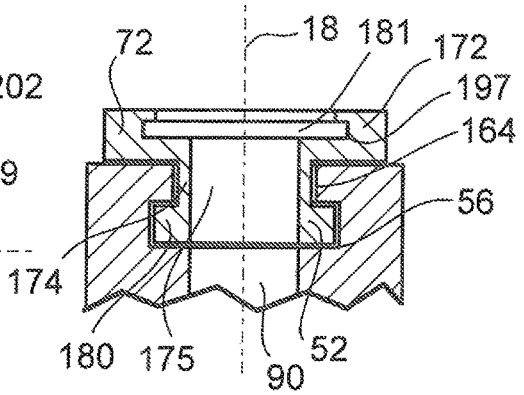
FIG. 5 is a side cross sectional view of the shell holder inserted within the ram top.

Referring to FIGS. 3-5, the second coupling portion 52 of the shell holder 72 is coupled to the first coupling element 50 of the ram top 74, and a receiving slot 181 of the shell holder 72 is coupled to the cartridge case 100 providing a fixed coupling as the case 100 is pressed into the die 32. Referring specifically to FIG. 5, the blind slot 56 and access slot 164 of the ram top 74 work together to define a "T-slot" allowing a corresponding T-slide of the second coupling portion 52 of the shell holder 72 to slide into the T-slot of the ram top 74 and prevent upward vertical movement of the shell holder 72 with respect to the ram top 74.

The shell holder 72 has a broad head 172 supported below by a narrowed cylindrical neck 174 extending downwardly from the head 172. The head 172 is defined by a cylinder having a receiving slot 181 extending diametrically across the axis 19 of the head 172 perpendicular to the centerline axis 18. The receiving slot 181 starts at a first side opening 182 and extends to a location just short of an opposed vertical wall 186 of the head 172. A width of the receiving slot 181 perpendicular to its extension along the diameter and hence perpendicular to the centerline 18 is less than the outside diameter of the head 172 to provide left and right retaining slot side walls 192, 194 separated by a space distance. The upper extent of the receiving slot 181 is positioned approximately 1/16 of an inch below an upper face 195 of the head 172 and the height of the receiving slot 181 measured along the centerline 18 may be approximately 1/16 inch.

An inner surface of the receiving slot 181 may contain a groove 197 corresponding to a rim 199 formed below an extraction groove cut around the circumference of the cartridge case 100 for receiving and interlocking with the cartridge case 100. In use, the cartridge case 100 is slid within the first side opening 182 of the receiving slot 181 so that the groove 197 and the rim 199 interlock, preventing vertical separation between the shell holder 72 and the cartridge case 100.

The head 172 of the shell holder 72 has a width 94 corresponding with the width of the blind slot 56 that is larger than the access slot 164 preventing the head 172 from entering the access slot 164. The neck 174 provides a narrow cylinder extending downward from the head 172 and having a width 95 extending diametrically across the neck 174 that is less than the access slot 164 thus allowing the neck 174 to fit within the access slot 164 through first side opening 58. In one embodiment, the neck 174 has a width 95 that is 0.01 to 0.03 inches or approximately 0.02 inches smaller than the width 98 of the access slot 164 allowing the centered neck 174 to move radially 0.005 to 0.015 inches or approximately at least 0.01 inches in all radial directions. In certain embodiments, the neck 174 may have a width that is up to or at least 0.02 inches, 0.03 inches, or 0.04 inches smaller than the width 98 of the access slot 164 and/or may allow the centered neck 174 to move up to or at least 0.01 inches, 0.015 inches, or 0.02 inches in all radial directions. A space 188 provided around the neck 174 allows for movement of the neck 174 along at least two orthogonal axes and in any direction from the centerline axis 18.

The neck 174 has a passage 175 extending along a length of the neck 174. A length of the neck 174 extending along the centerline axis 18 may measure 0.125 inches and slightly longer than the height of the access slot 164 allowing the neck 174 to fit within the access slot 164.

A lower end of the neck 174 contains a retaining flange 180 defined by a projecting collar extending around a bottom end of the neck 174. The retaining flange 180 has a width that is slightly larger than the width 98 of the access slot 164 preventing the retaining flange 180 from passing through the access slot 164. The width 95 of the retaining flange 180 is less than the width 94 of the blind slot 56 allowing the retaining flange 180 to fit within the blind slot 56 retaining the connection between the shell holder 72 and the ram top 74 as in a T-slot configuration.

In use, the second coupling portion 52 of the shell holder 72 is coupled to the first coupling element 50 of the ram top 74 by sliding the neck 174 of the shell holder 72 into the first side opening 58 of the access slot 164 allowing the neck 174 to sit within the access slot 184 while the retaining flange 180 of the shell holder 72 sits within the blind slot 56. The head 172 of the shell holder 72 remains above the upper face 66 of the ram top 74, sitting parallel to and resting on top of the ram top 74. The positioning of the shell holder 72 may deviate from the centerline axis 18 in all directions to align the shell holder 72 with respect to the die 32.

Figure 2:
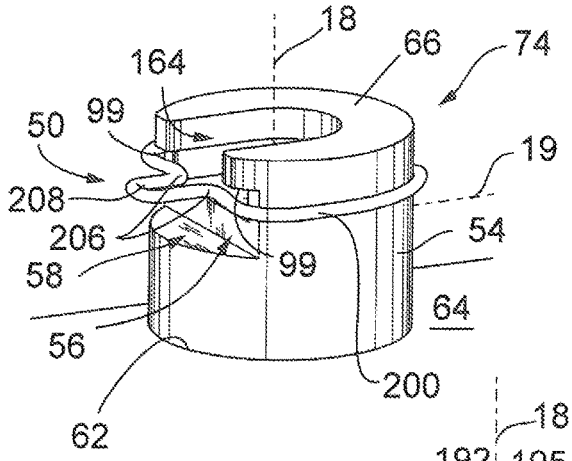
FIG. 2 is a perspective view of a top of the ram of FIG. 1 coupled to the frame and supporting a retaining clip biased in an upward position to prevent insertion of a shell holder until pressed down and securing the shell holder until pressed down again.

Referring to FIGS. 2-4, a retaining clip 200 may extend circumferentially around the ram top 74 along the outside surface of the left 82 and right 84 blind slot walls. The retaining clip 200 provides a substantially circular form having a rear opening defined by a pair of separated, opposed wire ends 202 canted radially outward from and perpendicular to the centerline axis 18 and inserted within similarly canted retaining holes 204 of the ram top 74. The wire ends 202 may form an acute angle and may have a space distance between ends of approximately 0.26 inches.

The retaining holes 204 extend through the left 82 and right 84 blind slot walls opposite the first side opening 58. The retaining holes 204 are positioned at a top of the left 82 and right 84 blind slot walls, just below the left 86 and right 87 access slot walls so that the retaining clip 200 abuts the upper stop undersurfaces 99 of the left 86 and right 87 access slot walls. The retaining holes 204 have a depth of approximately 0.26 inches extending through the blind slot walls allowing flexure of the wire ends 202 to deflect the retaining clip 200 to an upwardly biased position abutting the stop undersurfaces 99.

The wire ends 202 extend around the ram top 74 to a front of the retaining clip 200 converging toward the first side opening 58 of the blind slot 56, and bending inward to form two opposed shoulders 206 abutting the stop undersurfaces 99. The shoulders 206 are formed inwardly such that the stop undersurfaces 99 overhang the opposed shoulders 206 to prevent upward vertical extension of clip 200. The retaining clip 200 continues from the shoulders 206 to the front of the first side opening 58 and bending to converge at a U-shaped handle 208 extending radially outward from the ram top 74.

In use, the retaining clip 200 is biased in an upward position such that the shoulders 206 abut the stop undersurfaces 99 of the left 86 and right 87 access slot walls and the front end of the clip 200 containing the U-shaped handle 208 extends across the first side opening 58 of the ram top 74 blocking side entry access to the blind slot 56 (see FIG. 2). Flexing the handle 208 downward presses the shoulders 206 in a downward position toward a bottom end of the blind slot 56 to expose the first side opening 58 and allowing the shell holder 72 to enter the blind slot 56 and access slot 164 by sliding the neck 174 within the access slot 164 and the retaining flange 180 within the blind slot 56 (see FIG. 3). The handle 208 may form a "ramp" allowing the shell holder 72 to slide over the handle 208 and into the hollow channel 90. Removing downward force on the handle 208 deflects the handle 208 back to its biased state in the upward position (see FIG. 2).

Referring again to FIG. 1, the ram bottom 76 is attached to a lifting mechanism 78 including a pivot support plate 148 extending downwardly from the front of the bottom plate 21. The pivot support plate 148 has a front wall 151 having left 153 and right 155 sidewalls extending posterior to the left and right sides of the front wall 151 and having openings 156 receiving a shaft forming a pivot axis 160. A hand lever 48 pivoting about the pivot axis 160 carries a forward load arm 138 joined at an obtuse angle to a rear load arm 140. The rear load arm 140 carries the ram bottom with the ram 70 shaft extending upwardly therefrom, and the forward load arm 138 carries a handle 80 with the handle 80 extending upwardly therefrom. In one embodiment, the handle 80 is coupled to the rear load arm 140 by a bolt 141 that allows the handle 80 to be fixed in a certain position to allow the curvature of the handle 80 to be rotated to a left or right side depending on the user's hand dominance or preference.

In use, rotation of the handle 80 by the user in a downward direction 150 rotates the forward load arm 138 downward and the rear load arm 140 upward lifting the co-acting ram 70 vertically along the centerline axis 18 bringing the ram top 74 toward the die 32 and the cartridge case 100 into the die inner cavity 40 in an extended state. Rotation of the handle 80 in an upward direction rotates the forward load arm 138 upward and the rear load arm 149 downward dropping the co-acting ram 70 vertically along the centerline axis 18 and separating the ram top 74 from the die 32 and the cartridge case 100 from the die inner cavity 40 in a retracted state.

Figure 6:
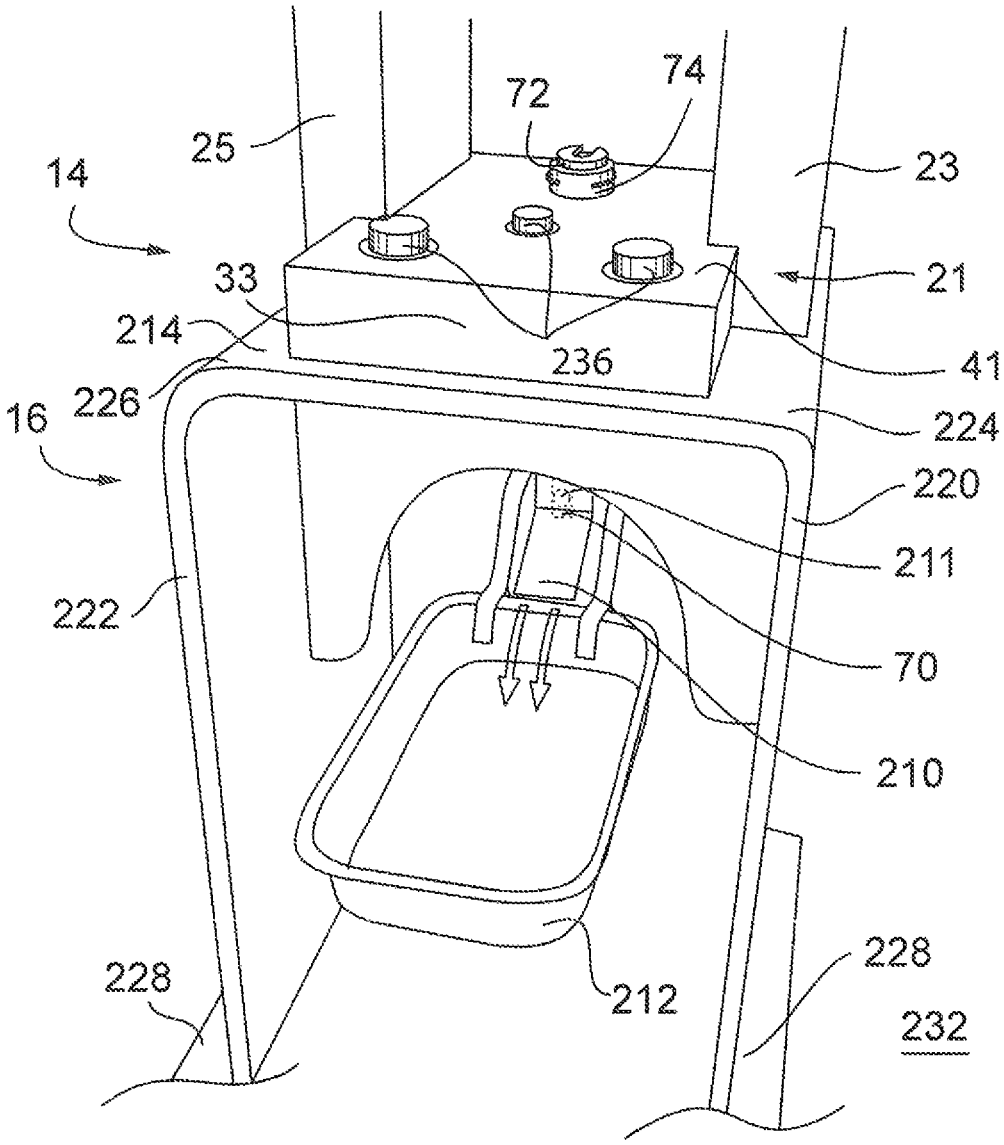
FIG. 6 is a rear view of the cartridge reloading press of FIG. 1 showing a lower end of the ram received by a deflector plate deflecting spent primer into a collection tray.

Referring to FIG. 6, in one embodiment, during a de-capping operation the de-capping rod 104 extends through the primer pocket of the cartridge case 100 and the spent primer falls into and through the channel 90 of the ram 70. The channel 90 extending through the length of the ram 70 may terminate at a rear exit port 211 formed within a rear sidewall 196 of the ram 70 allowing an uncapped primer from the cartridge cases 100 to exit the ram 70. A deflector sheet 210 may be positioned proximate the exit port 211 oriented downward and posterior to the ram 70 to deflect the spent primer into a collection plate 212 mounted below and proximate to the deflector sheet 210 to collect the spent primer.

Referring again to FIG. 1 and FIG. 6, the C-shaped frame 14 may be supported below by a table support base 16. The table support base 16 has a generally reversed U-shaped elevated frame having a flattened, horizontally extending top surface 214 supported on left 224 and right 226 sides by vertically extending legs 220, 222. The left 220 and right 222 legs extend along left 224 and right 226 sides of the top surface 214. The left 220 and right 222 legs may broaden as the legs extend downward to expand a width of the left 220 and right 222 legs contacting a support surface such as a workbench 232.

The bottom plate 21 of the C-shaped frame 14 is mounted forwardly on the top surface 214 so that the front portion 46 of the bottom plate 21 overhangs the front of the top surface 214 providing a space below for the lifting mechanism 78 to extend. The C-shaped frame 14 may be mounted to the top surface 214 by nuts and bolts 236 extending through the bottom plate 21 and top surface 214. The lower table support base 16 lifts the C-shaped frame 14 allowing the ram 70 and lifting mechanism 78 to extend downward from the bottom plate 21 without obstruction from the workbench 232.

A lower end of the left 220 and right 222 legs may contain outwardly extending mounting flanges 228 providing vertically extending holes 230 allowing the table support base 16 to be mounted to a support surface such as a workbench 232.

Holders 178 may be mounted on outer surfaces of the left 220 and right 222 legs having outwardly extending surfaces containing circular openings 234 for holding various reloading tools and equipment, such as interchangeable reloading dies 32 therein. The top plate 20 of the C-shaped frame 14 may also contain a rectangular tray 34 located behind the bore 30 providing a depression permitting various smaller components, such as cartridge cases and shell holders, to be stored within the tray 34 without rolling out or falling out.

In an alternative embodiment, the C-shaped frame 14 may be supported directly on a tabletop or workbench 232 without the table support base 16.

It is also contemplated that the C-shaped frame 14 may take different configurations, such as any "C" frame, "O" frame, "H" frame or turret press configuration known in the art, without departing from the spirit of the invention. The frames may mount one or more loading dies in an upper portion of the press while supporting the ram in a lower portion thus allowing the ram to move upward toward the die. It is also contemplated that the one or more dies may be mounted in a lower portion of the press while supporting the ram in an upper portion thus allowing the ram to move downward toward the die. The die(s) and rams may also be spaced apart in a configuration that is not characterized as "upper" and "lower" but still allowing the die and ram to move toward each other during the pressing operation.

It is contemplated that frame 12 may be constructed of cast iron or aluminum. Various components of the press 10 such as the ram 70 and spring clip 200 may be made of stainless steel or high-carbide alloy steel.

It is also contemplated that the present invention may be used with reloading both bottleneck cartridges as well as straight wall cartridges cases.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What I claim is:

1. A shell reloading press providing a vertically extending frame having a first portion for supporting die elements comprising a die with a die bore having a centerline and spaced from a second portion supporting an elongate cartridge case to be pressed into the die elements, the press comprising:

a ram supported by the second portion having an upwardly exposed coupling and movable in a vertical direction along a ram centerline between an extended position and a retracted position;

a shell holder having a head portion, the head portion providing an inner groove adapted to receive a rim of the elongate cartridge case to prevent separation between the elongate cartridge case and the shell holder and a downwardly exposed coupling releasably coupling the upwardly exposed coupling to prevent separation between the shell holder and ram;

wherein a space is provided between the downwardly exposed coupling and the upwardly exposed coupling allowing a shell holder centerline to deviate from the ram centerline in at least two orthogonal axes by at least 0.01 inches to align the shell holder centerline with the die bore centerline.

2. The press of claim 1 wherein the space allows the shell holder centerline to deviate from the ram centerline radially in all directions.

3. The press of claim 1 wherein the upwardly exposed coupling provides an inner bore.

4. The press of claim 3 wherein the downwardly exposed coupling provides a neck portion extending downwardly from the head portion of the shell holder, the neck portion insertable into the inner bore of the ram.

5. The press of claim 4 wherein the neck portion includes an expanded portion passing through a corresponding T-slot where the expanded portion is retained within the T-slot along the ram centerline.

6. The press of claim 5 wherein the T-slot is open at a side of the bore allowing the shell holder to slide perpendicular to the bore centerline such that the neck portion is received within the inner bore.

7. The press of claim 1 further comprising a spring-biased member providing a stop surface coupled to the ram resisting removal of the shell holder from the ram without applied pressure to the spring-biased member.

8. The press of claim 7 wherein the spring-biased member is an elastic form.

9. The press of claim 7 wherein the spring-biased member is a wire form.

10. The press of claim 9 wherein the wire form provides first and second wire ends opposite shoulders and the first and second wire ends are received within first and second sockets in the ram so that shoulders of the wire form are depressed from the stop surface with flexure of the wire ends.

11. The press of claim 10 wherein the wire form provides a handle portion projecting radially from the shoulders of the wire form to depress the shoulders when pressed.

12. The press of claim 1 wherein the die is supported by the first portion and the die bore is adapted to removably receive the elongate cartridge case when the ram is in the extended position.

13. The press of claim 1 wherein the ram is movable along the ram centerline between the extended position and the retracted position by a lever arm coupled to the ram by a bolt permitting fixed rotational positioning of the lever arm.

14. The press of claim 1 further comprising lateral wings extending from the frame and containing openings adapted to hold one more interchangeable dies.

15. The press of claim 1 further comprising a deflector plate positioned to receive a lower end of the inner bore of the ram and angled downwardly and rearwardly toward a rear of the frame.

16. A method of operating a shell reloading press providing a vertically extending frame having an upper arm for supporting die elements comprising a die with a die bore having a centerline and a lower arm supporting an elongate cartridge case to be pressed into the die elements, the press comprising a ram supported by the lower arm having an upwardly exposed coupling and movable in a vertical direction along a ram centerline between an extended position and a retracted position; and a shell holder having a head portion, the head portion providing an inner groove adapted to receive a rim of the elongate cartridge case to prevent separation between the elongate cartridge case and the shell holder and a downwardly exposed coupling releasably coupling the upwardly exposed coupling to prevent separation between the shell holder and ram, the method comprising the steps of:

moving a spring-biased member to a down state;

inserting the downwardly exposed coupling of the shell holder into the inner bore of the ram;

inserting the rim of the elongate cartridge case into the inner grove of the head portion of the shell holder;

moving the ram to an extended position; and adjusting an alignment of the shell holder so that the shell holder centerline deviates in at least two orthogonal axes by at least 0.01 inches from the ram centerline to align the shell holder centerline with the die bore centerline.

17. The method of claim 16 wherein the shell holder is moveable within the inner bore of the ram radially in all directions.

* * * * *